US011180878B1

(12) United States Patent
Meier et al.

(10) Patent No.: US 11,180,878 B1
(45) Date of Patent: Nov. 23, 2021

(54) QUILTING MACHINE WITH TILTING SEWING ASSEMBLY

(71) Applicants: Mark S. Meier, Carlsbad, CA (US); Karen A. Brow-Meier, Carlsbad, CA (US)

(72) Inventors: Mark S. Meier, Carlsbad, CA (US); Karen A. Brow-Meier, Carlsbad, CA (US)

( * ) Notice: Subject to any disclaimer, the term of this patent is extended or adjusted under 35 U.S.C. 154(b) by 0 days.

(21) Appl. No.: 17/144,338

(22) Filed: Jan. 8, 2021

(51) Int. Cl.
*D05B 11/00* (2006.01)
*D05B 3/02* (2006.01)

(52) U.S. Cl.
CPC ..... *D05B 11/00* (2013.01); *D05B 3/02* (2013.01)

(58) Field of Classification Search
CPC ..... D05B 11/00; D05B 3/02; D05B 23/00; D05B 39/005; D05B 75/06
USPC ..... 112/119
See application file for complete search history.

(56) References Cited

U.S. PATENT DOCUMENTS 454,520 A * 6/1891 Gibbs ..... D05B 11/00 112/119
2,318,877 A * 5/1943 Meyer ..... D06C 3/00 38/102.6
3,354,850 A * 11/1967 Story ..... D05B 11/00 112/118
3,515,080 A 6/1970 Ramsey
4,192,241 A 3/1980 Reed et al.
4,503,788 A * 3/1985 Giannuzzi ..... D05B 23/00 112/470.06
4,557,206 A 12/1985 Iwase
4,590,877 A 5/1986 Schwarzberger
4,669,405 A 6/1987 Resta et al.
4,813,362 A * 3/1989 Vogt ..... D05B 33/00 112/104
5,103,747 A 4/1992 Resta et al.
5,287,820 A * 2/1994 Stutznacker ..... D05B 11/00 112/117
5,540,165 A 7/1996 Katou et al.
6,079,341 A 6/2000 Resta
6,615,756 B2 9/2003 Barrus
6,631,688 B1 10/2003 Maag
(Continued)

FOREIGN PATENT DOCUMENTS

GB 2027331 A * 2/1980 ..... D05B 23/008

*Primary Examiner* — Alissa L Hoey
*Assistant Examiner* — Patrick J. Lynch
(74) *Attorney, Agent, or Firm* — Stetina Brunda Garred and Brucker

(57) ABSTRACT

A quilting machine includes a frame sized and configured to support a sheet of fabric and a tilting sewing assembly. The tilting sewing assembly includes a needle beam defining a needle beam longitudinal axis, and a needle head attached to the needle that translates along the needle beam longitudinal axis. The assembly includes a hook beam defining a hook beam longitudinal axis disposed separate from and parallel to the needle beam longitudinal axis, and an axis of rotation parallel to the needle beam and the hook beam with the hook beam disposed between the needle beam and the hook beam. The needle head is between the needle beam and the hook beam. The tilting sewing assembly is configured to pivot about the axis of rotation with the needle beam and the hook beam translating laterally about the axis of rotation to move the needle head relative to the frame.

13 Claims, 14 Drawing Sheets

(56) References Cited

U.S. PATENT DOCUMENTS

| | | | | |
|---|---|---|---|---|
| 6,792,884 | B1 | 9/2004 | Barrus | |
| 7,011,031 | B1 * | 3/2006 | Bradley | D05B 11/00 112/119 |
| 7,739,972 | B2 * | 6/2010 | Sturm | D05B 11/00 112/475.08 |
| 9,145,630 | B2 | 9/2015 | McCoy et al. | |
| 9,267,222 | B2 | 2/2016 | Schnaufer et al. | |
| 9,487,896 | B2 | 11/2016 | Schwarzberger et al. | |
| 9,869,043 | B2 | 1/2018 | Spengler et al. | |
| 2007/0199493 | A1 * | 8/2007 | Block | D05B 11/005 112/475.04 |
| 2009/0195649 | A1 * | 8/2009 | Gylling | G06T 7/0004 348/125 |
| 2009/0272304 | A1 * | 11/2009 | Watts | D05B 11/00 112/118 |

* cited by examiner

QUILTING MACHINE WITH TILTING SEWING ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a quilting device. More particularly, the present disclosure relates to a quilting machine with a tilting sewing assembly.

2. Related Art

A quilt is typically a fabric construction made of padding enclosed between layers or sheets of sewable material and kept in place by lines of stitching. The lines of stitching are typically applied in a decorative design or shapes. There are two general areas where quilting is pursued, the industrial and for those individuals interested in the art and craft of quilting (domestic or home use). The two areas represent specific needs and focus that largely does not overlap. For example, bed mattress manufacturing often involves the sewing of large swaths of sewable material that is supplied to the quilting machine in very large rolls. In contrast, the arts and crafts quilter is interested in providing their quilt with unique one of a kind stitching on bed sized quilts. U.S. Pat. No. 3,354,850 to Story, issued Nov. 28, 1967, is illustrative of an industrial quilting machine that incidentally would not fit in the average arts and crafts quilter's house or apartment.

Until the 1980's, home quilting was typically performed by hand or with conventional sewing machines (with difficulty). U.S. Pat. No. 4,192,241 to Reed, issued Mar. 11, 1980, discloses a quilting machine that has become known as the long arm and is the mainstay of home quilters to this present time. There is a problem typical to long arm sewing machines in that to be useful they require a large heavy frame that generally fills a room to the exclusion of the room's normal function. A dining room, living room, garage or bedroom for example, becomes too crowded to function properly with a long arm and supporting frame present. A number of designs have attempted to address this problem with the creation of the table top quilting frame, which is quite similar to conventional long arm quilting machines but replaces the normal heavy framework with a folding table (of dubious stability). It is claimed that the table top quilting machine allows the machine to be portable, collapsible and transportable. However, table top machines fall short of these claims and perform at a disadvantage compared to the conventional long arm machines these folding table designs are trying to surpass.

On another tack, one of the big challenges for industrial quilting machines 60 years ago was limited sewing machine throat depth (the distance back from the needle to the portion of the sewing machine body that joins the base of the sewing machine to the upper portion of the sewing machine). Normally available throat depths in normally available sewing machines prevented the needle from reaching sufficiently deep into the web of the product being sewed. The solution was to actually do away with the throat. A good example of this is in the previously mentioned U.S. Pat. No. 3,354,850, where a conventional sewing machine appears to be so cut so as to remove its throat. The needle and hook were then mechanically re-coupled together to make the separate sewing machine parts function synchronously again. Other industrial designs have coupled the needle and the hook mechanically or electro-mechanically with the needle and hook drive units physically separated but cooperating to produce proper stitching. Some industrial designs are gantry type where the gantry sits on linear guides that allow motion transverse to the line of sewing, and other designs utilize a gantry fixed to the floor with the only motion being of the sewing heads operating transverse to the line of feed motion of the material to be sewed. The application of an industrial style quilting machine for domestic or home use is also problematic primarily because of size.

In view of the foregoing, there is a need in the art for an improved quilting machine suitable for domestic or home use.

BRIEF SUMMARY

In accordance with one embodiment, there is provided a quilting machine for use with sewing a sheet of fabric. The quilting machine includes a machine frame sized and configured to support a sheet of fabric, and a tilting sewing assembly. The tilting assembly includes a needle beam defining a needle beam longitudinal axis. The tilting assembly further includes a needle head attached to the needle beam and sized and configured to translate along the needle beam longitudinal axis. The tilting assembly further includes a hook beam defining a hook beam longitudinal axis disposed separate from and parallel to the needle beam longitudinal axis. The needle head is positioned between the needle beam and the hook beam. The tilting assembly further includes an axis of rotation parallel to the needle beam and the hook beam with the hook beam disposed between the needle beam and the axis of rotation. The tilting sewing assembly is configured to pivot about the axis of rotation with the needle beam and the hook beam translating laterally about the axis of rotation to move the needle head relative to the machine frame.

According to various embodiments, the tilting sewing assembly may include a beam support attached to the needle beam and the hook beam and configured to laterally translate the needle beam and the hook beam about the axis of rotation. The machine frame may include support arms sized and configured to position a sheet of fabric between the needle head and the hook beam. The support arms may include first, second, third and fourth support arms. The tilting sewing assembly may be disposed between the first and second support arms and the third and fourth support arms. The first, second, third and fourth support arms may be sized and configured to cooperatively support a sheet of fabric between the first and second support arms and the third and fourth support arms. The first and second support arms may be sized and configured to cooperatively support ends of a fabric roll. The third and fourth support arms may be sized and configured to cooperatively support ends of a fabric roll.

Further, the first, second, third and fourth support arms may each include an extended position and a stored position. In the stored position the first, second, third and fourth support arms are closer to the needle beam than in the extended position. Each of the first, second, third and fourth support arms may pivot between the extended and stored position. The needle beam may include first and second needle beam sections. The tilting sewing assembly may include a deployed position with the first and second needle beam sections longitudinally endwise aligned. The tilting sewing assembly may include a folded position with the first and second needle beam sections disposed laterally along each other. The first and second needle beam sections may each include an inner end hingedly attached to each other. The hook beam may include first and second hook beam sections. The first and second hook beam sections may be longitudinally endwise aligned in the deployed position of the tilting sewing assembly. The tilting sewing assembly may include a folded position with the first and second needle beam sections disposed laterally along each other. The first and second hook beam sections may each include an inner end hingedly attached to each other. The quilting machine may further include a pivot shaft that axially defines the axis of rotation with the tilting sewing assembly configured to pivot about the pivot shaft.

According to another embodiment, there is provided a method of quilting. The method of quilting includes a step a) of providing a quilting machine. The quilting machine includes a machine frame sized and configured to support a sheet of fabric, and a tilting sewing assembly. The tilting sewing assembly includes a needle beam defining a needle beam longitudinal axis, a needle head attached to the needle beam and sized and configured to translate along the needle beam longitudinal axis, and a hook beam defining a hook beam longitudinal axis disposed separate from and parallel to the needle beam longitudinal axis. The needle head is positioned between the needle beam and the hook beam. The tilting sewing assembly further includes an axis of rotation parallel to the needle beam and the hook beam with the hook beam disposed between the needle beam and the rotation axis. The tilting sewing assembly is configured to pivot about the axis of rotation with the needle beam and the hook beam axis of rotation to move the needle head relative to the machine frame. The method of quilting further includes step b) of positioning a first sheet of fabric between the needle head and the hook beam. The method of quilting further includes step c) of pivoting the tilting sewing assembly back and forth about the axis of rotation while sewing the first sheet of fabric with the sewing head. The method of quilting further includes step d) of moving the needle head along the needle beam longitudinal axis while sewing the first sheet of fabric with the sewing head. The steps b) and c) may be done simultaneously. The step b) may include positioning a second sheet of fabric between the needle head and the hook beam. The step c) may include sewing through the first and second sheets of fabric, and the step d) may include sewing through the first, and second sheets of fabric.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Figure 4:
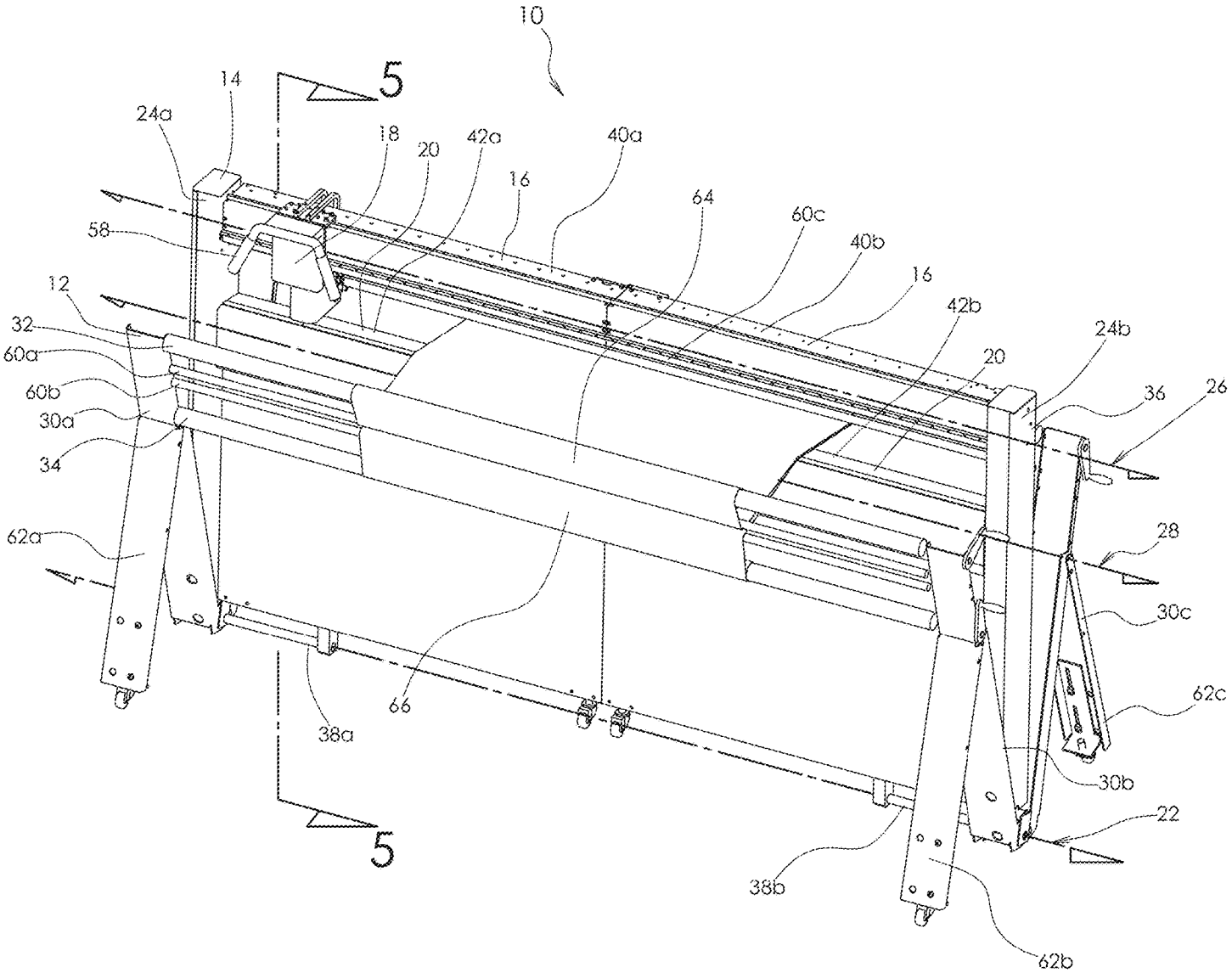
FIG. 4 is a perspective view of the quilting machine of FIG. 1 with fabric wound upon the quilt rollers.
Figures 6, 6A:
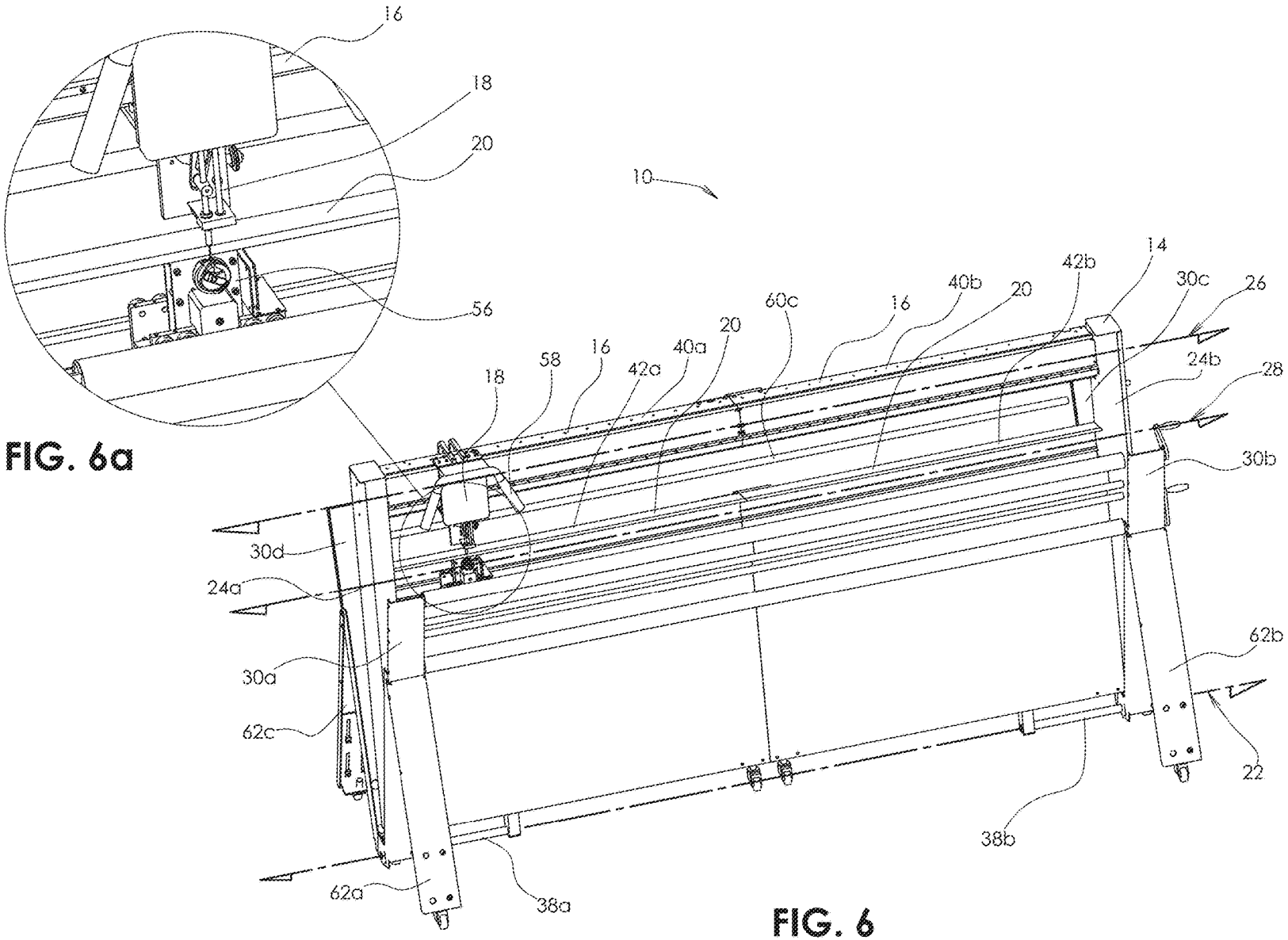
FIG. 6 is a perspective view of the quilting machine.
Figure 7:
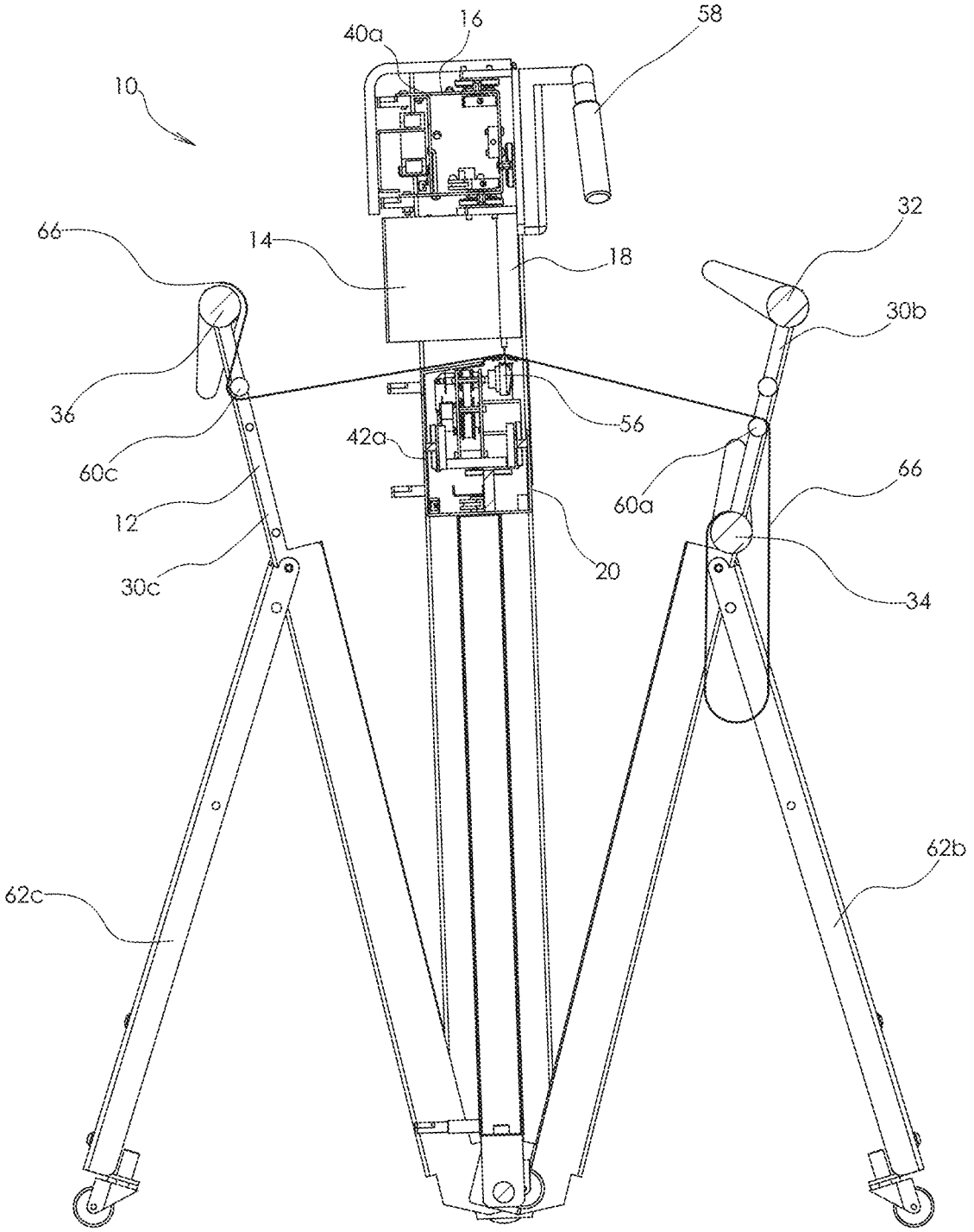
Figure 8:
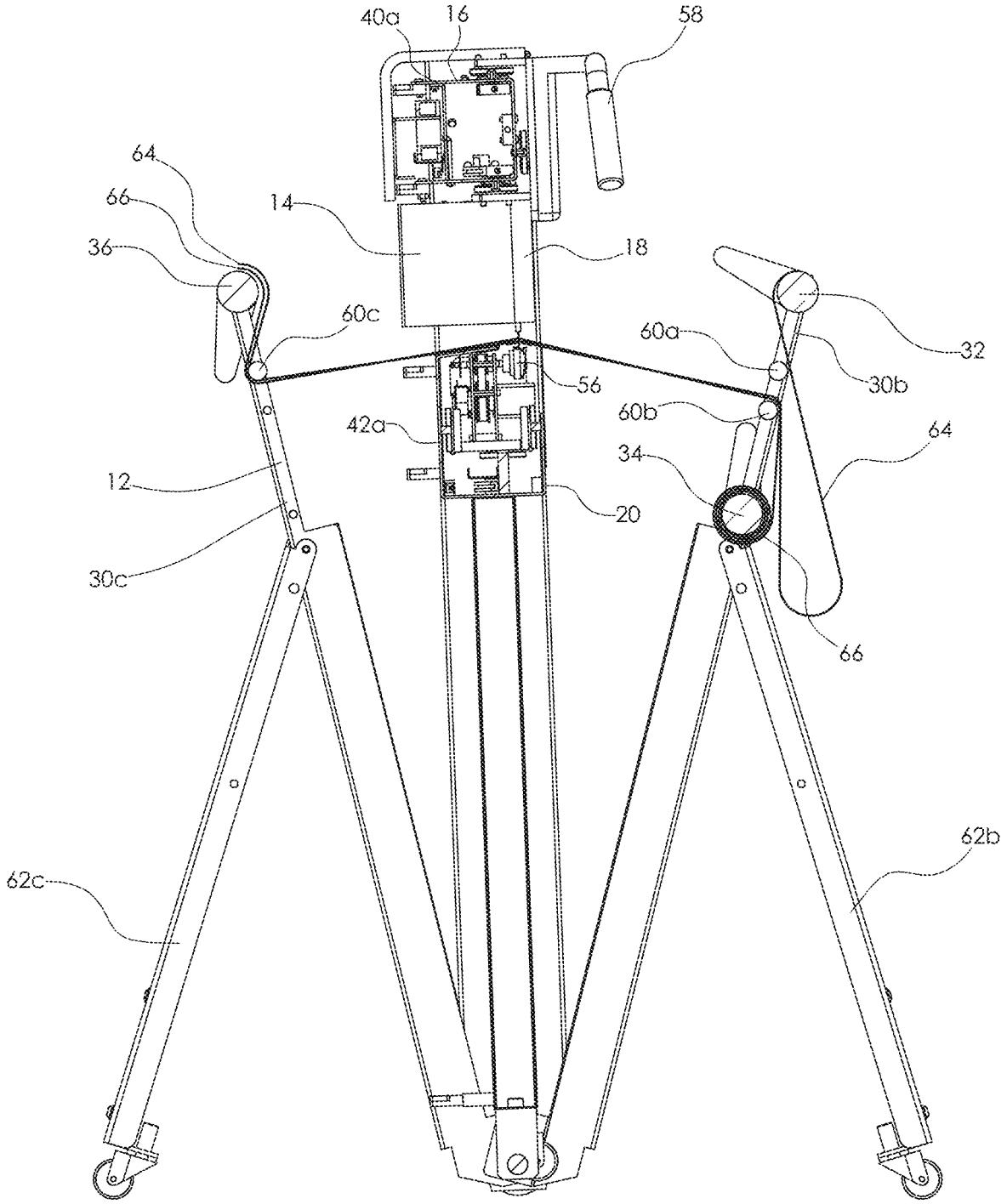
Figure 9:
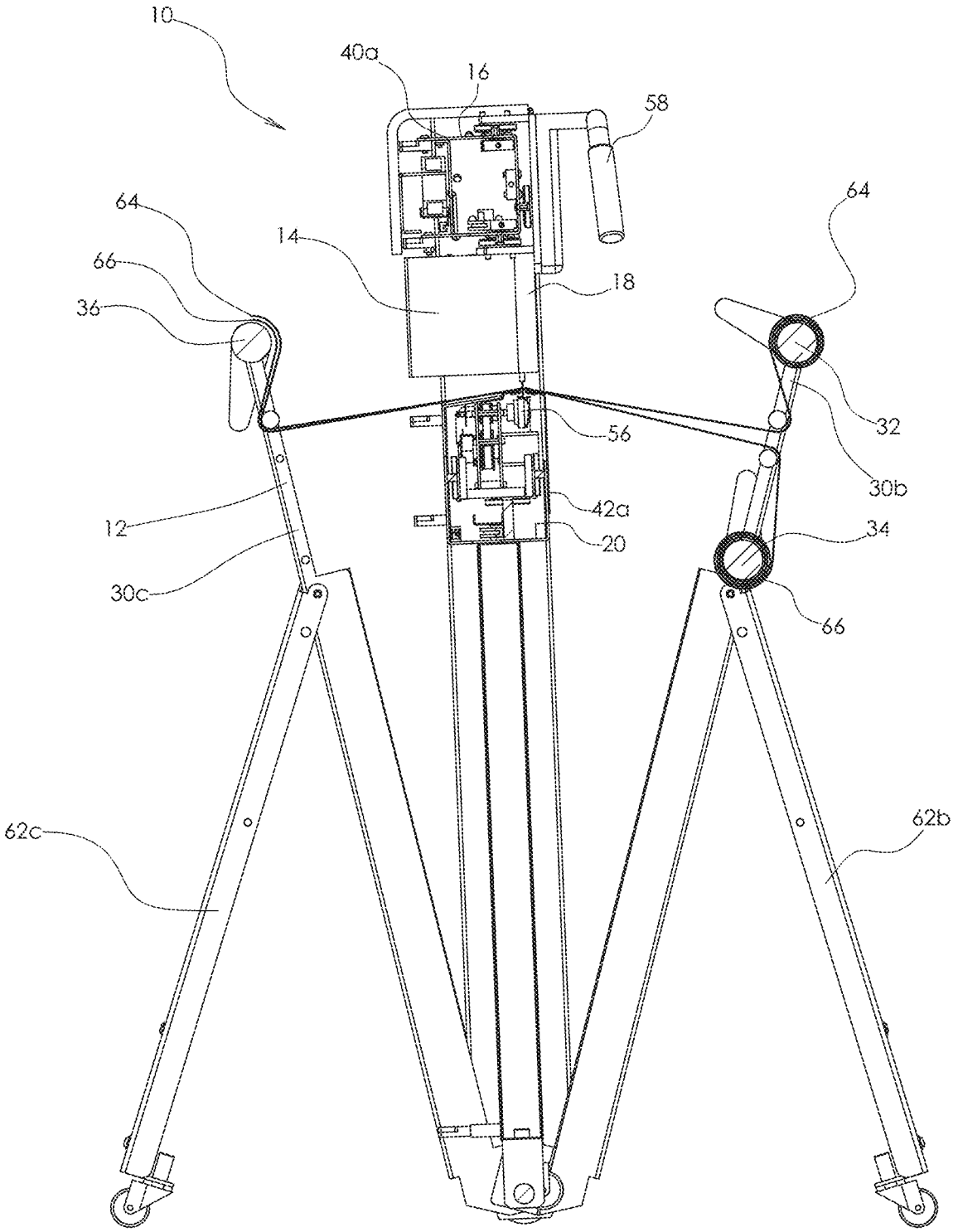
Figure 10:
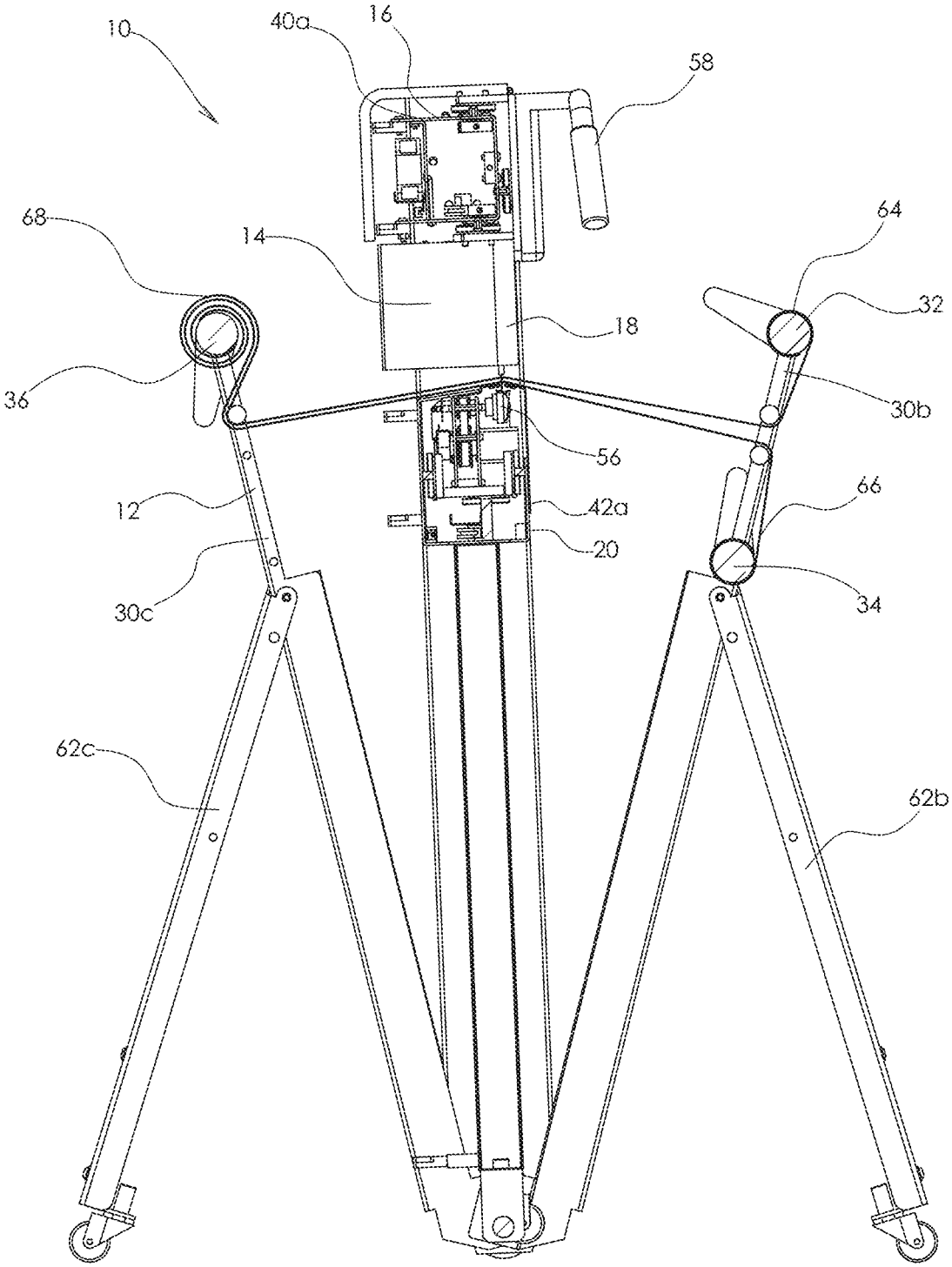
Figure 11:
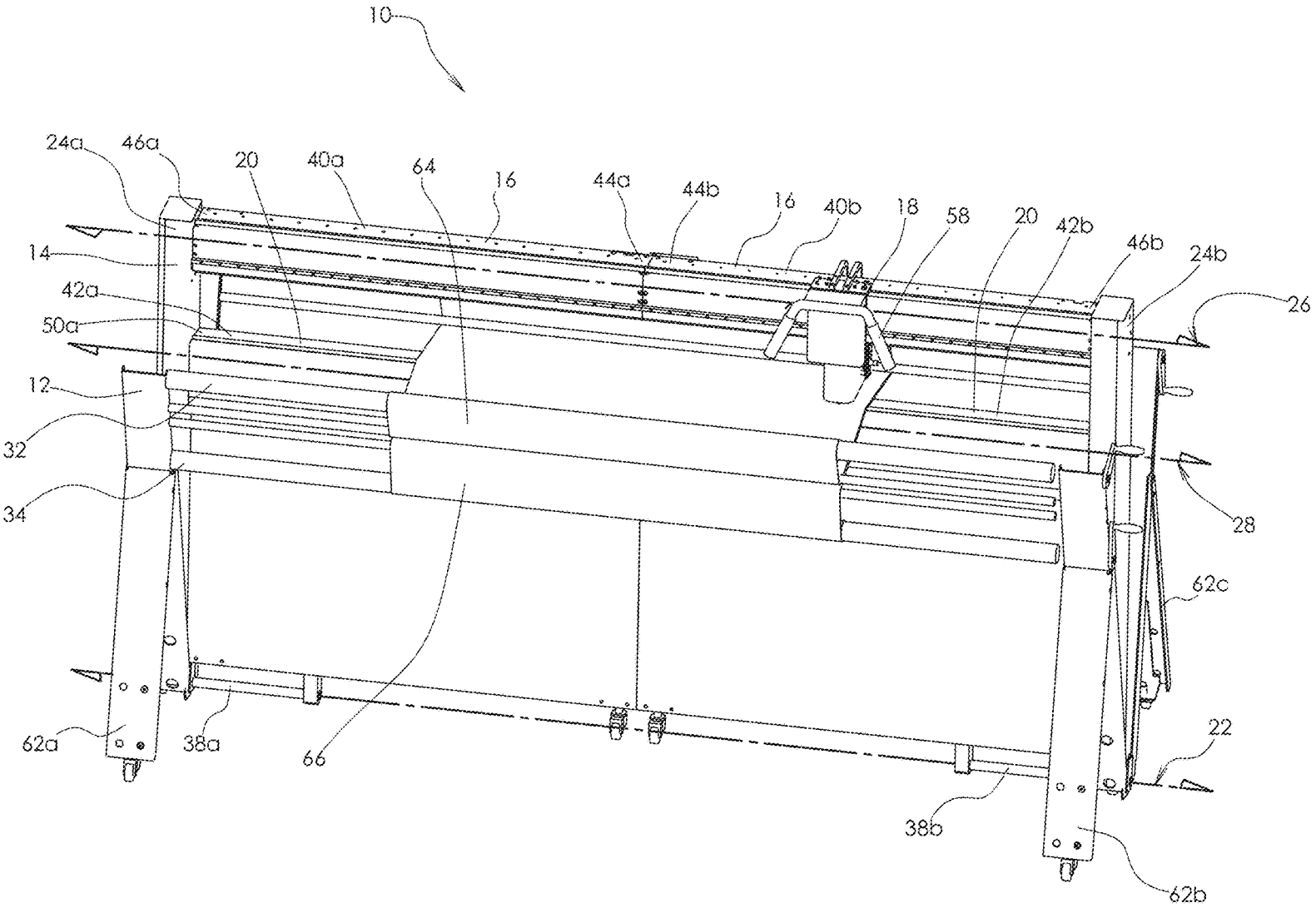
Figure 12:
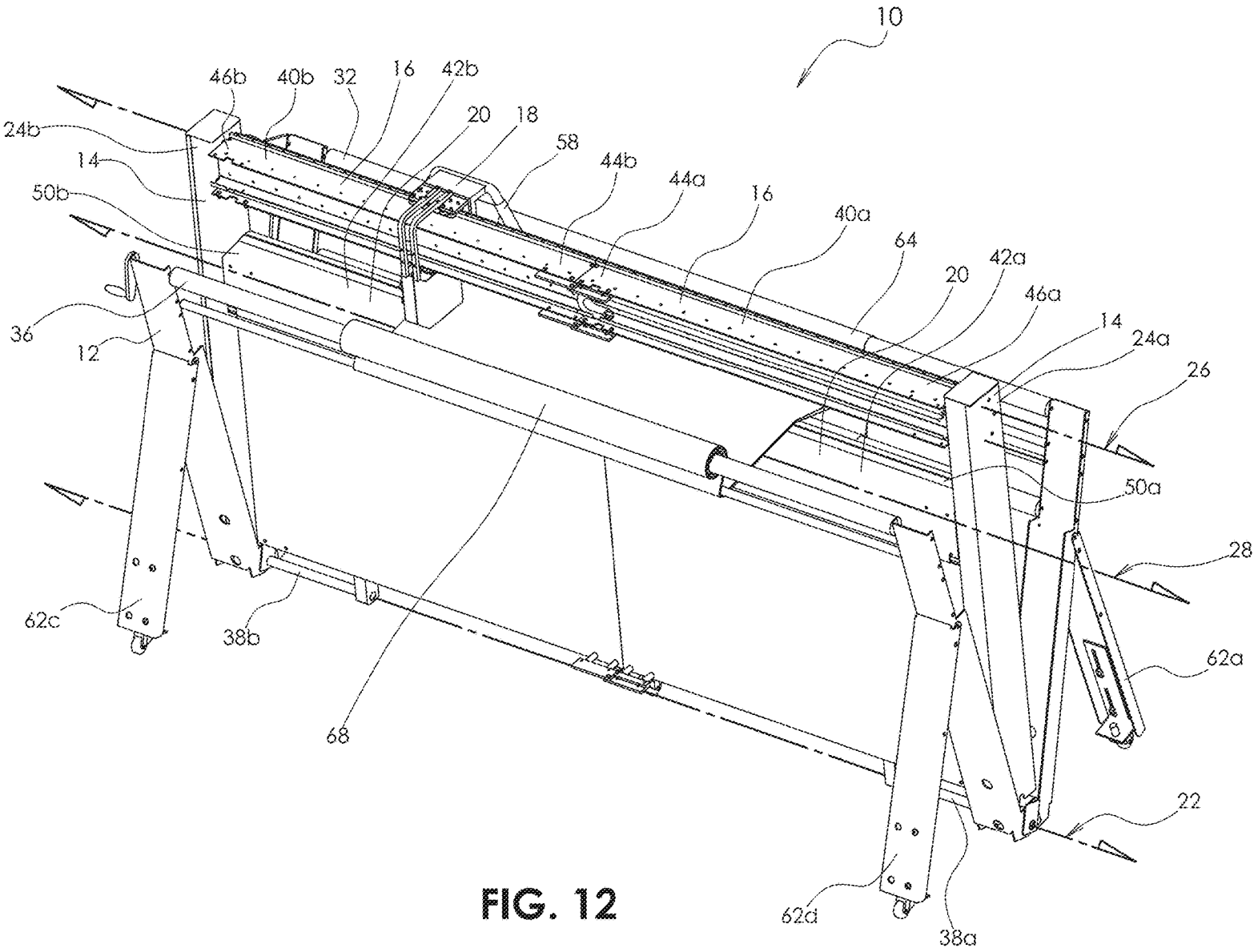
Figure 13:
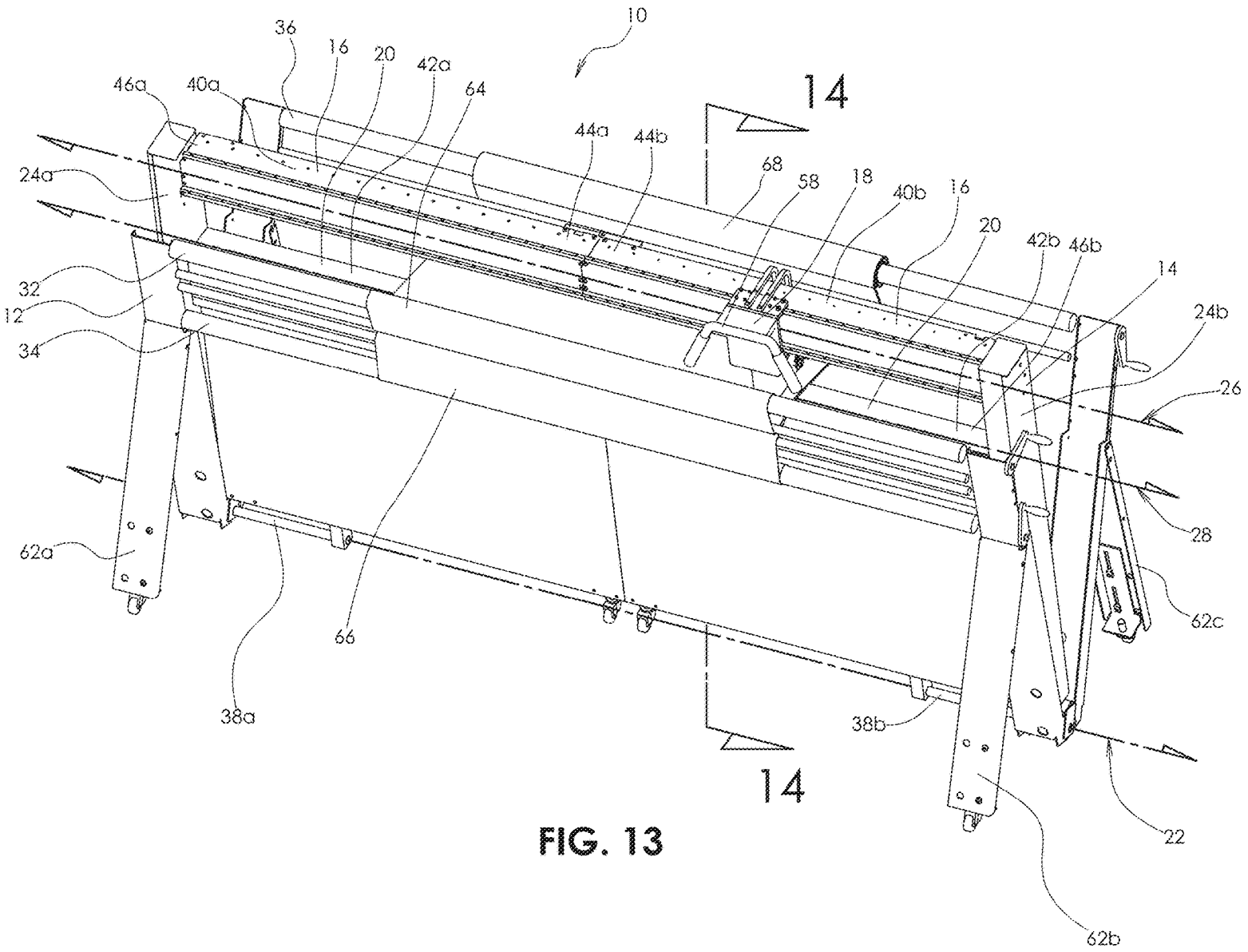
Figure 14:
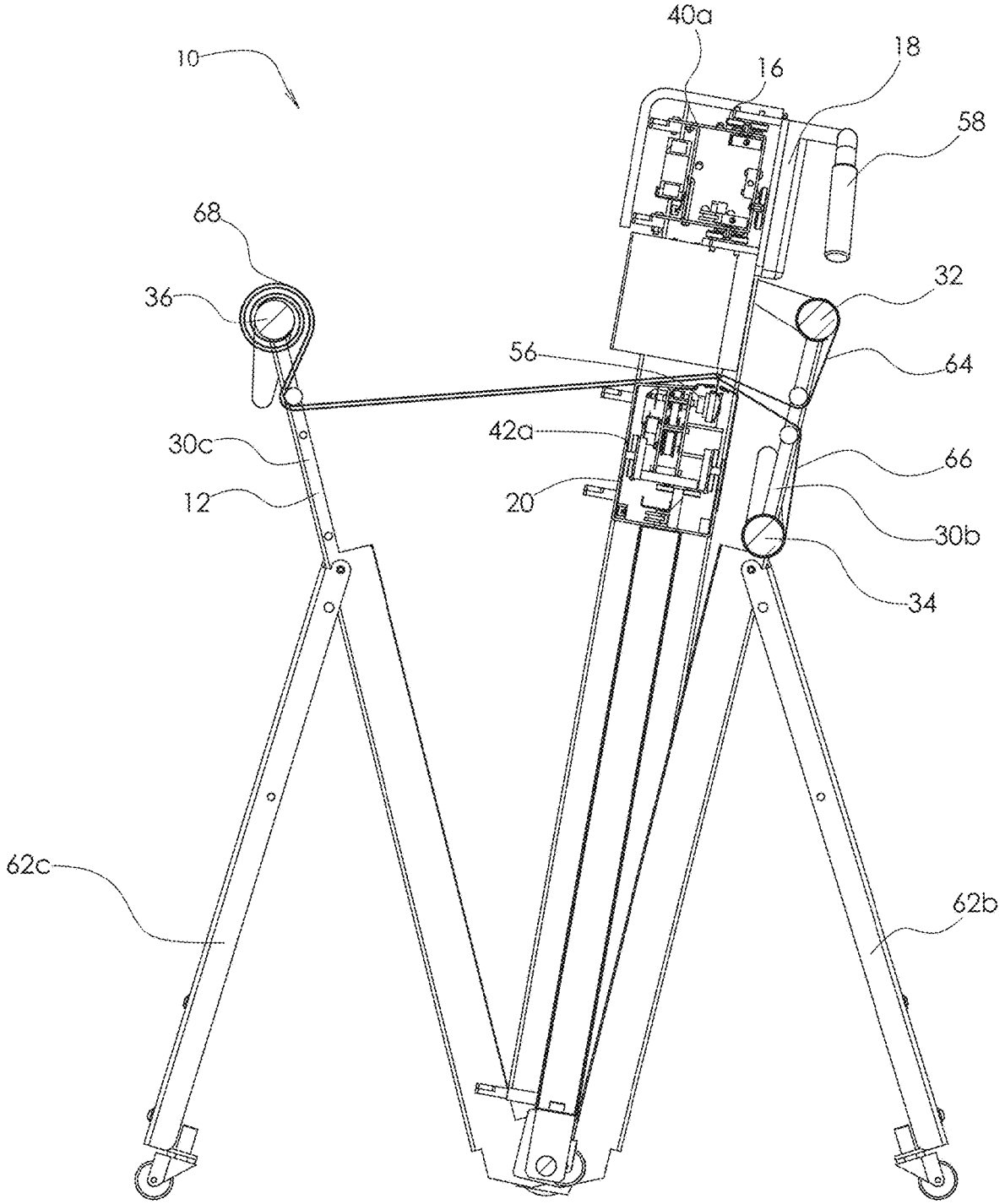

FIG. **6*a* is an enlarged perspective view of a portion of the quilting machine of FIG. 6**;

FIG. 7 is a cross-sectional view of the quilting machine with quilt bottom fabric being rolled upon a quilt bottom roller with an opposite fabric edge attached to a quilt take-up roller;

FIG. 8 is a cross-sectional view of the quilting machine of FIG. 7 with a portion of the quilt top fabric being rolled upon a quilt top roller with the opposite fabric edge attached to the quilt take-up roller with the quilt bottom roller is rolled taut;

FIG. 9 is a cross-sectional view of the quilting machine with portions of quilt top fabric and quilt bottom fabric being rolled taut with the opposite fabric edges started upon the quilt take-up roller;

FIG. 10 is a cross-sectional view of the quilting machine with a portion of quilt top fabric and quilt bottom fabric being rolled onto the quilt take-up roller;

FIG. 11 is a perspective view of the quilting machine of FIG. 4 as shown with a needle head in a different position along a needle beam;

FIG. 12 is a perspective view of the quilting machine of FIG. 11 as shown from an opposite perspective view;

FIG. 13 is a perspective view of the quilting machine of FIG. 11 with the tilting sewing assembly pivoted into a different position; and FIG. 14 is cross-sectional side view of the quilting machine of FIG. 13 as viewed along axis 14-14.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
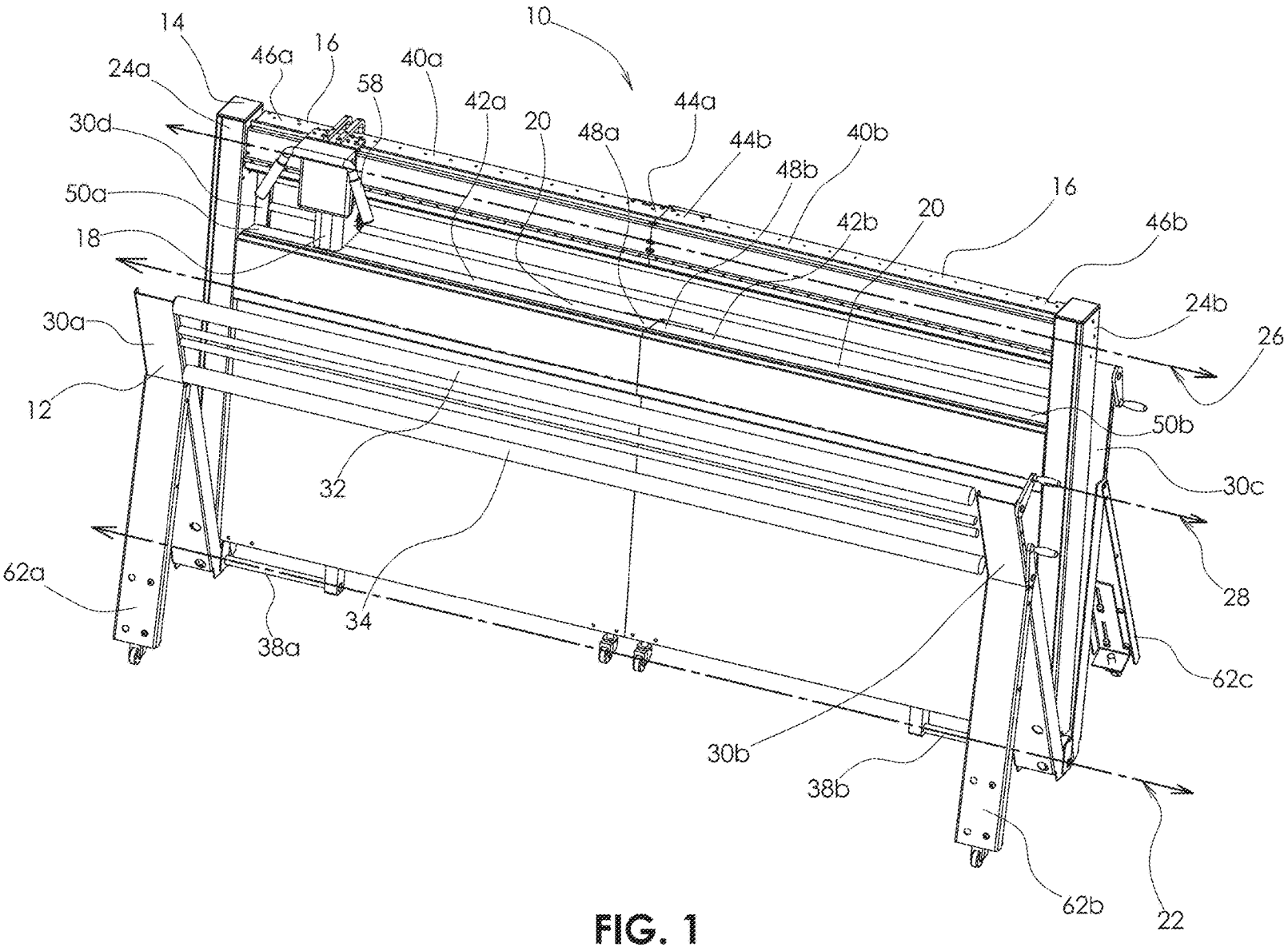
FIG. 1 is a perspective view of a quilting machine with a tilting sewing assembly and with first, second, third and fourth support arms in an extended position with quilt rollers.

Referring now to FIG. 1 there is depicted a perspective view of a quilting machine 10. As will be appreciated, the quilting machine 10 is configured for use with a sheet of fabric. In this regard, the quilting machine 10 may be utilized to sew or stich together multiple sheets of different fabric such as in the case of producing a quilt. As used herein fabric refers to any cloth, textile or other material, whether woven, knitted or wadded, and any sewable material that is generally is sheet, strip or swath like form. Often fabric is provided in rolls or spools. Various sheets or layers of fabric may be overlaid upon each other and the quilting machine 10 may be used to sew through the sheets to combine them in a finished quilt.

As will be discussed in detail below the quilting machine 10 includes a machine frame 12 and a tilting sewing assembly 14 that includes a needle beam 16, a needle head 18, a hook beam 20 and an axis of rotation 22. In the embodiment shown, the machine frame 12 includes a beam support in the form of side beams 24*a-b*. The needle beam 16 defines a needle beam longitudinal axis 26. The needle head 18 is attached to the needle beam 16 and sized and configured to translate along the needle beam longitudinal axis 26. The hook beam 20 defines a hook beam longitudinal axis 28 disposed separate from and parallel to the needle beam longitudinal axis 26. The needle head 18 is positioned between the needle beam 16 and the hook beam 20. The axis of rotation 22 is parallel to the needle beam 16 and the hook beam 20 with the needle head 18 disposed between the needle beam 16 and the hook beam 20. The tilting sewing assembly 14 is configured to pivot about the axis of rotation 22 with the needle beam 16 and the hook beam 20 translating laterally about the axis of rotation 22 to move the needle head 18 relative to the machine frame 12.

Figure 2:
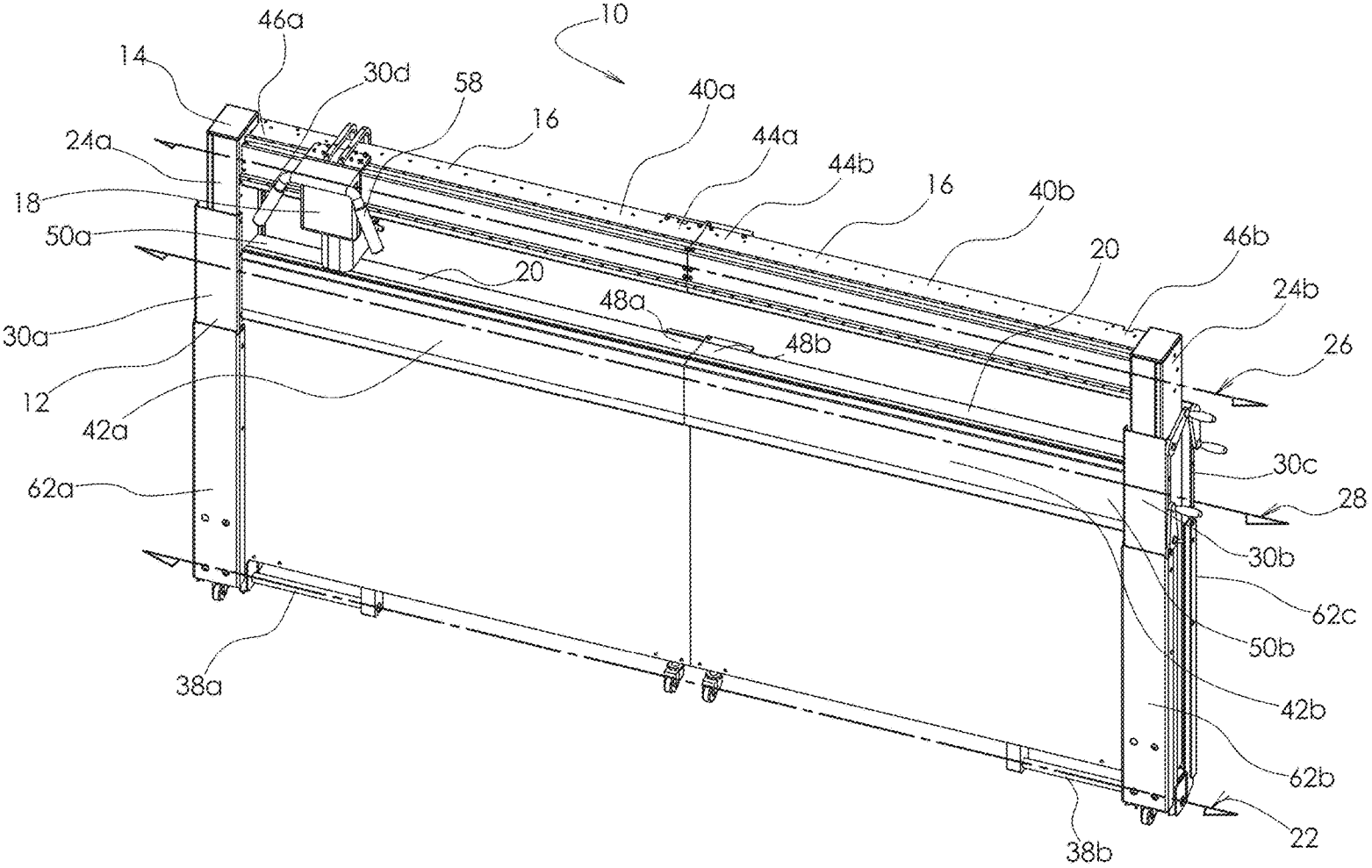
FIG. 2 is a perspective view of the quilting machine of FIG. 1 with the first, second, third and fourth support arms in a stored position without quilt rollers.
Figure 3:
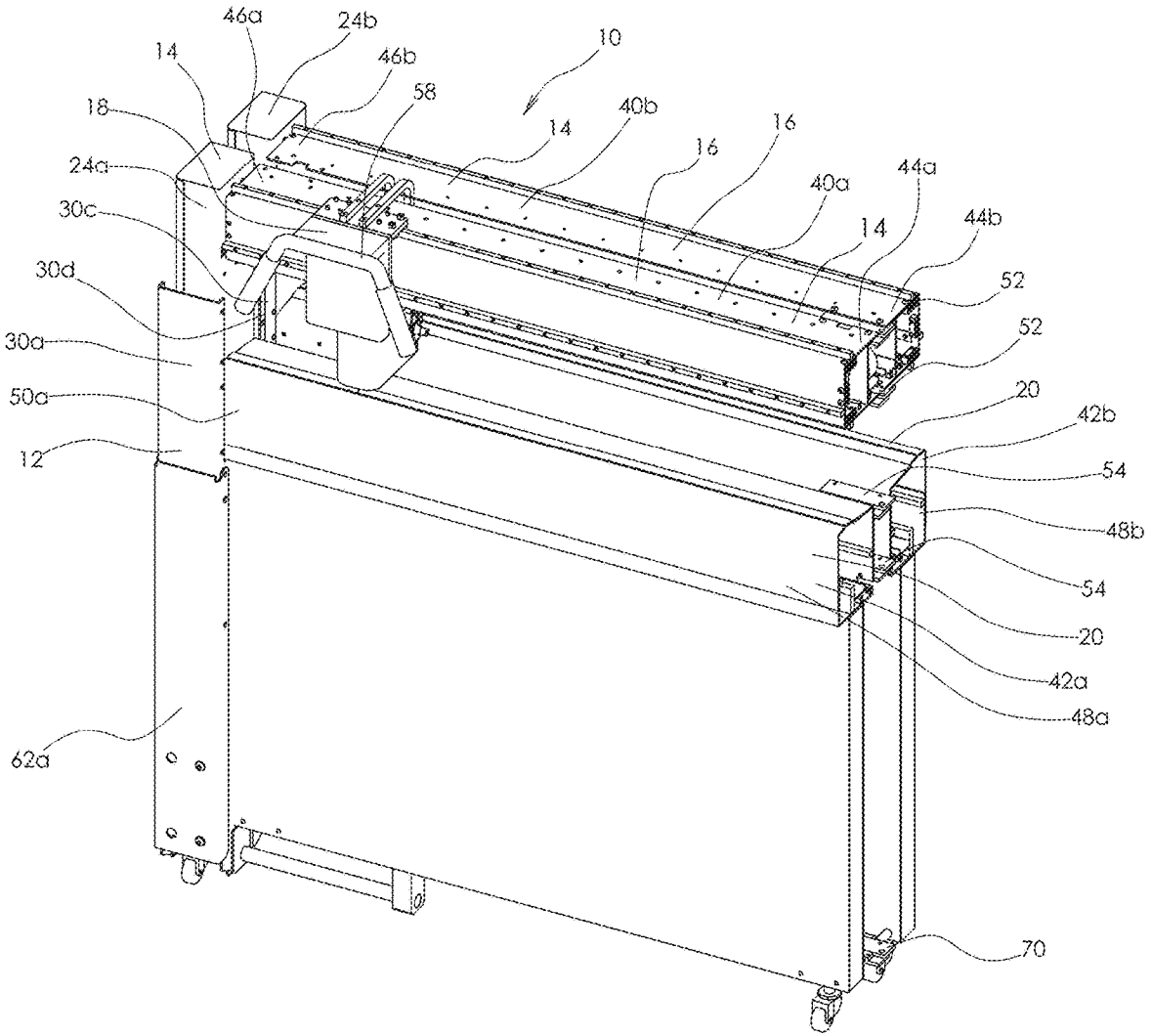
FIG. 3 is a perspective view of the quilting machine of FIG. 2 with the tilting sewing assembly in a folded position, suitable for storage.
Figure 5:
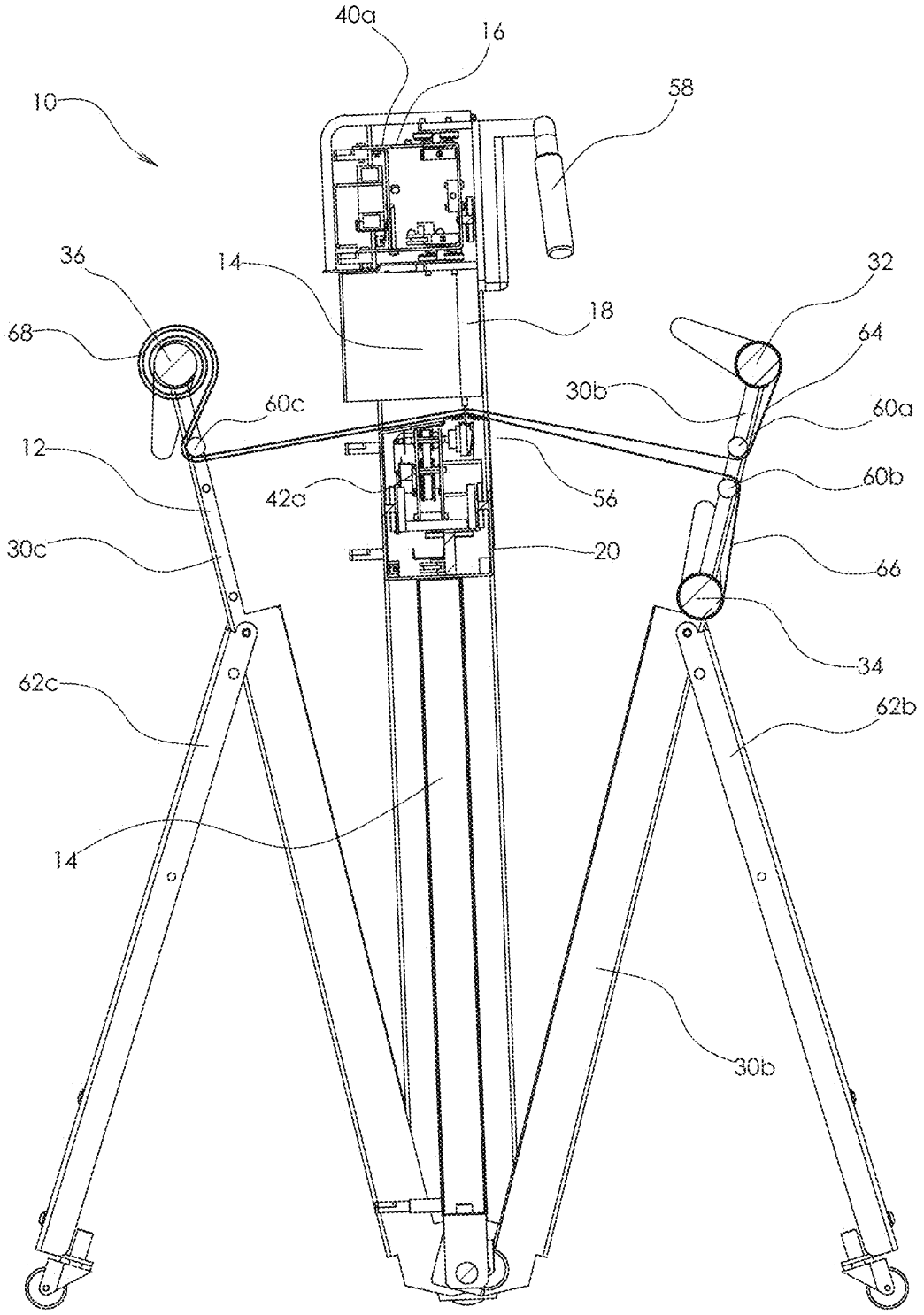
FIG. 5 is a cross-sectional side view of the quilting machine of FIG. 4 as viewed along axis 5-5.

In the embodiment depicted, the machine frame 12 may include first, second, third and fourth support arms 30*a-d*. FIG. 1 depicts the first, second, third and fourth support arms 30*a-d* in an extended position. FIG. 2 is a perspective view of the quilting machine 10 of FIG. 1 with the first, second, third and fourth support arms 30*a-d* in a stored position. FIG. 3 is a perspective view of the quilting machine 10 of FIG. 2 with the tilting sewing assembly 14 in a folded position. FIG. 4 is a perspective view of the quilting machine 10 of FIG. 1 with fabric rolls. FIG. 5 is a cross-sectional side view of the quilting machine 10 as viewed along axis 5-5. FIG. 6 is a perspective view of the quilting machine 10 and FIG. 6*a* is an enlarged portion of the quilting machine of FIG. 6.

As used herein the term machine frame 12 broadly refers to a structural member which is supportive of the tilting sewing assembly 14 such that the tilting sewing assembly 14 may move relative to the machine frame 12. The machine frame 12 may be connected with the tilting sewing assembly 14 directly or via intermediate components. The machine frame 12 may be used to place quilting machine 10 upon a working surface, such as a floor of a room.

According to various embodiments, the tilting sewing assembly 14 may include a beam support, such as in the form of the of the side beams 24*a-b*. The side beams 24*a-b* are attached to the needle beam 16 and the hook beam 20 and configured to laterally translate the needle beam 16 and the hook beam 20 about the axis of rotation 22. The side beams 24*a-b* are attached to the respective ends of the needle beam 16 and the hook beam 20.

As mentioned above the machine frame 12 may include the first, second, third and fourth support arms 30*a-d*. Legs 60*a-d* may be provided to provide structural support to the first, second, third and fourth support arms 30*a-d* and may be pivotally connected so as to allow the legs 60*a-d* to be folded open for deployment and closed for compact storage. The lower portion of the legs 60*a-d* may rest upon the floor upon which the quilting machine 10 is supported. The tilting sewing assembly 14 is disposed between the first and second support arms 30*a,b* and the third and fourth support arms 30*c,d*. The first and second support arms 30*a,b* may be sized and configured to cooperatively support ends of a fabric roller, such as a quilt top roller 32 and a quilt bottom roller 34. The third and fourth support arms 30*c-d* may be sized and configured to cooperatively support ends of a fabric roller, such as a quilt take-up roller 36. The first, second, third and fourth support arms 30*a-d* may be sized and configured to position a sheet of fabric between the needle head 18 and the hook beam 20. The first, second, third and fourth support arms 30*a-d* may be sized and configured to cooperatively support a sheet of fabric between the first and second support arms 30*a-b* and the third and fourth support arms 30*c-d*.

The first, second, third and fourth support arms 30*a-d* may each include an extended position and a stored position. In the stored position the first, second, third and fourth support arms 30*a-d* are closer to the needle beam 16 than in the extended position. Each of the first, second, third and fourth support arms 30*a-d* may pivot between the extended and stored position. FIG. 2 depicts the first, second, third and fourth support arms 30*a-d* collapsed in a vertical position immediately adjacent to the needle beam 16 in the stored position. In this regard, the stored position is a position of the first, second, third and fourth support arms 30*a-d* that reduces the overall size dimensions of the quilting machine 10. In the embodiment depicted, in the stored position, the width of the quilting machine 10 is significantly reduced compared to that of the extended position. It is contemplated that one of ordinary skill in the art will recognize other arrangements that may be implemented to facilitate such folded position.

The tilting sewing assembly 14 may include first and second pivot shafts 38*a-b*. The tilting sewing assembly 14 is configured to pivot about the pivot shafts 38*a-b*. The first and second pivot shafts 38*a-b* may be aligned along the axis of rotation 22. In this respect the first and second pivot shafts 38*a-b* define the axis of rotation 22. The side beams 24*a-b* may be configured to be respectively engaged with the first and second pivot shafts 38*a-b* to allow rotational movement of the side beam 24*a* relative to the first pivot shaft 38*a* and the side beam 24*b* to the second pivot shaft 38*b*. Moreover, the first, second, third and fourth support arms 30*a-d* may be coupled to the tilting sewing assembly 14 via the first and second pivot shafts 38*a-b*. The first and third support arms 30*a,c* may be attached to the side beam 24*a* with the first pivot shaft 38*a*. The second and fourth support arms 30*b,d* maybe attached to the side beam 24*b* with the second pivot shaft 38*b*.

The tilting sewing assembly 14 may include a deployed position and a folded position. In this regard, the needle beam 16 may include first and second needle beam sections 40*a-b* and the hook beam 20 may include first and second hook beam section 42*a-b*. In the deployed position the first and second needle beam sections 40*a-b* are longitudinally endwise aligned. Similarly, in the deployed position the first and second hook beam sections 42*a-b* are longitudinally endwise aligned. In this regard FIGS. 1 and 2 depict the tilting sewing assembly 14 in the deployed position. FIG. 3 depicts the tilting sewing assembly 14 in the folded position with the first and second needle beam sections 40*a-b* are disposed laterally along each other.

The first and second needle beam sections 40*a-b* may each include an inner end 44*a-b* and an outer end 46*a-b*. The first and second hook beam sections 42*a-b* may each include an inner end 48*a-b* and an outer end 50*a-b*. The side beam 24*a* is attached to the needle beam 16 and hook beam 20 at the outer ends 46*a*, 48*a*, and the side beam 24*b* is attached to the needle beam 16 and hook beam 20 at the outer ends 46*b*, 48*b*. The first and second needle beam sections 40*a-b* may be endwise connected to each other at the inner ends

44*a-b*, and the first and second hook beam sections 42*a-b* may be endwise connected to each other at the inner ends 48*a-b*. The first and second needle beam sections 40*a-b* may be hingedly attached to each other, and the first and second hook beam sections 42*a-b* may be hingedly attached to each other. In this regard, the tilting sewing assembly 14 may include a needle beam hinge 52 and a hook beam hinge 54 to facilitate the tilting sewing assembly 14 to be configured between the deployed and folded positions. The needle beam hinge 52 is attached to and connects the inner ends 44*a-b* of the first and second needle beam sections 40*a-b*. The hook beam hinge 54 is attached to and connects the inner ends 48*a-b* of the first and second hook beam sections 42*a-b*. A machine frame hinge 70 connects a lower portion of the machine frame 12. With the tilting sewing assembly 14 in the folded position, the length of the quilting machine 10 is significantly reduced compared to that of the deployed position. In the embodiment depicted the overall length of the quilting machine 10 is about halved when in the folded position compared to the deployed position. It is contemplated that one of ordinary skill in the art will recognize other arrangements that may be implemented to facilitate such folded position.

The tilting sewing assembly 14 further includes a hook head 56 that is attached to and configured to move along or inside the hook beam 20. The hook head 56 is connected to the hook beam 20 in a manner which allows the hook head 56 to translate along the hook beam longitudinal axis 28. The hook head 56 is aligned with the needle head 18. The needle head 18 and the hook head 56 are coupled either mechanically or electro-mechanically so that motion of the needle head 16 moves the hook head 56 synchronously, thus maintaining alignment between the needle head 16 and the hook head 56. In this respect various computer controllers and servo motors and such may be additionally provided for controlling and moving the tilting of the tilting sewing assembly 14 and the movements of the needle head 18 and the hook head 56 respectively along the needle beam 16 and the hook beam 20. The needle head 18 and hook head 56 includes all necessary components and sub-assemblies to cooperatively function to perform sewing functions to create stitches through fabric with needle and thread. It is contemplated that the various components of the needle head 18 may be selected from those which are well known to one of ordinary skill in the art and may include needle, thread spools, thread tension controls, thread guides, motors and controllers, pulleys, fabric feeder, and/or any other components and sub-assemblies.

The needle head 18 is connected to the needle beam 16 in a manner which allows the needle head 18 to translate along the needle beam longitudinal axis 26. As denoted herein such translation along the needle beam longitudinal axis 26 refers to the needle head 18 being constrained to move along a linear path parallel to the needle beam 16. In this regard, the needle beam 16 may include guide rails or other arrangements that run the length of the needle beam 16 to facilitate such relative movement and may include any of those components, such as rollers, wheels, sliders, etc., which are well known to one of ordinary skill in the art. With a sheet of fabric positioned between and orthogonal to the needle beam 16 and the hook beam 20, such movement allows the needle head 18 to translate in a direction parallel to the quilt top roller 32, the quilt bottom roller 34, the quilt take-up roller 36, the needle beam longitudinal axis 26 and the hook beam longitudinal axis 28 (this may be referred to as an "X-direction" relative to fabric immediately under and engaged with the needle head 18).

The tilting sewing assembly 14 is configured to swing the needle head 18 though a shallow arc relative to the machine frame 12 between the first and second support arms 30*a-b* and the third and fourth support arms 30*c-d*. In this respect the needle beam 16 and the hook beam 20 are configured to translate parallel and lateral to the axis of rotation 22. With a sheet of fabric positioned between and orthogonal to the needle beam 16 and the hook beam 20, such tilting allows the needle head 18 to have a component of movement in a direction perpendicular to the quilt top roller 32, the quilt bottom roller 34, the quilt take-up roller 36, the needle beam longitudinal axis 26 and the hook beam longitudinal axis 28 (this may be referred to as a "Y-direction" relative to fabric immediately under and engaged with the needle head 18).

The needle head 18 may include handles 58. The handles 58 may allow a user to move the needle head 18 along the needle beam 16 and tilt the tilting sewing assembly 14 back and forth to facilitate an ease of movement of the needle head 18 in both the X-direction and Y-direction either independently or together. This may thus allow for the smooth sewing of stitches in lines and curves.

The following is a discussion of how the quilting machine 10 may be used in operation. Referring now to FIG. 7 there is a cross-sectional view of the quilting machine 10 with a quilt bottom fabric 66 being initially rolled upon the quilt bottom roller 34 with an opposite fabric edge attached to the quilt take-up roller 36. FIG. 8 is a cross-sectional view of the quilting machine 10 of FIG. 7 with a portion of quilt top fabric 64 being rolled from the quilt bottom roller 34 onto the quilt take-up roller 36. The machine frame 10 may further include deflector rollers 60*a-c*. The fabric may be looped or draped about the deflector rollers 60*a,c*. FIG. 9 is a cross-sectional view of the quilting machine 10 with portions of quilt top fabric 64 and quilt bottom fabric 66 being rolled taut with the opposite fabric edges started upon the quilt top roller 32. FIG. 10 is a cross-sectional view of the quilting machine 10 with a portion of quilt top fabric 64 and quilt bottom fabric 66 being rolled onto the quilt take-up roller 36. The fabric may be looped or draped about the deflector rollers 60*b,c*. The deflector rollers 60*a-c* are sized and configured to position the fabric generally orthogonal to and between the needle beam 16 and the hook beam 20 to allow the needle head 18 and the hook head 56 to carry out sewing operations through the fabric. As seen in the cross-sectional side view of FIG. 5, the portion of the quilt top fabric 64 from the quilt top roller 32 and the portion of the quilt bottom fabric 66 from the quilt bottom roller 34 are positioned coplanar with and overlaid upon each other and together are rolled upon the quilt take-up roller 36. When the quilt top fabric 64 and the quilt bottom fabric 66 are sewn, this forms sewn quilt fabric 68 that is wound upon the quilt take-up roller 36.

FIG. 11 is a perspective view of the quilting machine of FIG. 4 as shown with the needle head 18 in a different position along a needle beam 16 (i.e., moved along the X-direction). FIG. 12 is a perspective view of the quilting machine of FIG. 11 as shown from an opposite perspective view. FIG. 13 is a perspective view of the quilting machine 10 of FIG. 11 with the tilting sewing assembly 14 pivoted into a different position as tilted or pivoted from the previous positioning (i.e., moved along the X-direction). FIG. 14 is a cross-sectional side view of the quilting machine of FIG. 13 as viewed along axis 14-14. As such, it is understood that an operator may simultaneously move the needle head 18 in the X-direction and Y-direction to perform sewing or stitching across and through the layers or sheets of fabric between the needle head 18 and the hook head 58. It is further understood that the tilting sewing assembly 14 is configured to tilt or swing through various positions other than as shown in the exemplary figures. Likewise, the needle head 18 and the hook head 58 are configured to move along various positions respectively along the needle beam 16 and the hook beam 20 other than as shown in the exemplary figures. As the operator finishes the desired stitches the combined fabric may be progressively wound onto the quilt take-up roller 36. As such, the quilt take-up roller 36 includes the finished portions of the stitched material (i.e., finished portions of the resulting quilt).

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A quilting machine for use with sewing a sheet of fabric with the quilting machine being supported upon a floor, the quilting machine comprising:

a machine frame including legs sized and configured to rest upon the floor upon which the quilting machine is supported and support arms sized and configured to support a sheet of fabric; and a tilting sewing assembly supported by the machine frame including:

a needle beam defining a needle beam longitudinal axis;

a needle head attached to the needle beam and sized and configured to translate along the needle beam along the needle beam longitudinal axis;

a hook beam defining a hook beam longitudinal axis disposed separate from and parallel to the needle beam longitudinal axis, the needle head being positioned between the needle beam and the hook beam;

an axis of rotation parallel to the needle beam and the hook beam with the hook beam disposed between the needle beam and the axis of rotation, the tilting sewing assembly being configured to pivot about the axis of rotation with the needle beam and the hook beam moving about the axis of rotation to move the needle head relative to the machine frame when the legs are resting upon the floor; and a pivot shaft that axially defines the axis of rotation with the tilting sewing assembly configured to pivot about the pivot shaft.

2. The quilting machine of claim 1 wherein the tilting sewing assembly includes a beam support attached to the needle beam and the hook beam and configured to move the needle beam and the hook beam about the axis of rotation.

3. The quilting machine of claim 1 wherein the support arms are sized and configured to position the sheet of fabric between the needle head and the hook beam.

4. The quilting machine of claim 3 wherein the support arms includes first, second, third and fourth arms, the tilting sewing assembly is disposed between the first and second arms and the third and fourth arms, the first, second, third and fourth arms are sized and configured to cooperatively support the sheet of fabric between the first and second arms and the third and fourth arms.

5. The quilting machine of claim 4 the first and second arms are sized and configured to cooperatively support ends of a fabric roll, the third and fourth arms are sized and configured to cooperatively support ends of another fabric roll.

6. The quilting machine of claim 5 wherein the first, second, third and fourth arms each include an extended position and a stored position, in the stored position the first, second, third and fourth arms are closer to the needle beam than in the extended position.

7. The quilting machine of claim 6 wherein each of the first, second, third and fourth arms pivot between the extended and stored position.

8. The quilting machine of claim 1 wherein the needle beam includes first and second needle beam sections, the tilting sewing assembly includes a deployed position with the first and second needle beam sections longitudinally endwise aligned.

9. The quilting machine of claim 8 wherein the tilting sewing assembly includes a folded position with the first and second needle beam sections disposed laterally along each other.

10. The quilting machine of claim 9 wherein the first and second needle beam sections each include an inner end hingedly attached to each other.

11. The quilting machine of claim 8 wherein the hook beam includes first and second hook beam sections, the first and second hook beam sections are longitudinally endwise aligned in the deployed position of the tilting sewing assembly.

12. The quilting machine of claim 11 wherein the tilting sewing assembly includes a folded position with the first and second needle beam sections disposed laterally along each other.

13. The quilting machine of claim 12 wherein the first and second hook beam sections each include an inner end hingedly attached to each other.

* * * * *